US007900485B2

(12) United States Patent
Lee et al.

(10) Patent No.: US 7,900,485 B2
(45) Date of Patent: Mar. 8, 2011

(54) WASHING MACHINE

(75) Inventors: Soon Jo Lee, Changwon-si (KR); Ho Cheol Kwon, Changwon-si (KR); Beom Jun Kim, Changwon-si (KR); Hyun Soo Kim, Changwon-si (KR); Hack Chai Song, Changwon-si (KR); Kwang Young Lee, Changwon-si (KR); Eun Suk Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 666 days.

(21) Appl. No.: 11/782,953

(22) Filed: Jul. 25, 2007

(65) Prior Publication Data

US 2008/0028803 A1 Feb. 7, 2008

(30) Foreign Application Priority Data

Jul. 27, 2006 (KR) ..... 10-2006-0070796

(51) Int. Cl.
*D06F 37/20* (2006.01)
*F16M 5/00* (2006.01)

(52) U.S. Cl. ..... 68/3 R; 248/188.8

(58) Field of Classification Search ..... 68/3 R, 68/23 R, 23.1; 248/650, 188.8
See application file for complete search history.

(56) References Cited

U.S. PATENT DOCUMENTS

| | | | | |
|---|---|---|---|---|
| 2,520,366 | A * | 8/1950 | Kirby | 68/148 |
| 2,665,575 | A * | 1/1954 | Cockerill et al. | 68/23 R |
| 3,260,510 | A * | 7/1966 | Ranson | 366/165.2 |
| 4,949,923 | A * | 8/1990 | Daily | 248/188.3 |
| 5,853,520 | A * | 12/1998 | Rich et al. | 156/293 |
| 6,871,826 | B2 * | 3/2005 | Oyama et al. | 248/188.8 |
| 7,597,294 | B2 * | 10/2009 | Lotz | 248/188.3 |
| 2002/0139908 | A1 * | 10/2002 | Oyama et al. | 248/188.8 |
| 2002/0139909 | A1 | 10/2002 | Oyama et al. | 248/188.8 |
| 2005/0116134 | A1 * | 6/2005 | Lee et al. | 248/650 |

FOREIGN PATENT DOCUMENTS

| | | |
|---|---|---|
| CN | 1621600 A | 6/2005 |
| JP | 10-103331 | 4/1998 |

OTHER PUBLICATIONS

Chinese Office Action dated Jun. 19, 2009.

* cited by examiner

*Primary Examiner* — Joseph L Perrin
(74) *Attorney, Agent, or Firm* — Ked & Associates, LLP

(57) ABSTRACT

A washing machine having height adjustable legs is provided. The washing machine may include a base provided at a bottom of the washing machine, a plurality of legs coupled to the base, and an over-unscrewed prevention member provided with each leg. Each leg may include a bolt that is height-adjustably assembled at the base. The over-unscrewed prevention member may be provided at the bolt of each leg and caught by the base when the legs are unscrewed so as to set a maximum unscrew height of the legs.

9 Claims, 6 Drawing Sheets

WASHING MACHINE

This Nonprovisional application claims priority under 35 U.S.C. §119(a) on Patent Application No. 10-2006-0070796 filed in Korea on Jul. 27, 2006, the entire contents of which are hereby incorporated by reference.

BACKGROUND OF THE INVENTION

1. Field of the Invention

The present invention relates to a washing machine and, more particularly, to a washing machine having legs at a base to adjust the height thereof.

2. Description of the Background Art

In general, a washing machine removes pollutes from clothes and linens by sequentially performing predetermined operations, such as washing, rinsing, and spin-drying, using water and detergent. Hereinafter, laundry is referred as clothes and linens.

The washing machine includes a base at the bottom of the washing machine. The base supports the weight of the washing machine and includes a plurality of legs for adjusting the installation height of the washing machine and for balancing the washing machine, horizontally. Each of the legs includes a bolt unit screw-assembled at one of four corners of the base and a support disposed at the bottom of the bolt unit and placed at a location where the washing machine is installed. If the leg rotates in one direction, the height of the washing machine increases because the bolt unit is drawn out from the base in a downward direction. On the contrary, if the leg rotates in the other direction, the height of the washing machine decreases because the bolt unit is inserted into the base in an upward direction. That is, the installation height of the washing machine can be adjusted, and the washing machine can be horizontally balanced by turning the blot unit in one of directions.

However, a washing machine has a problem that the legs may be over-unscrewed or completely separated from the base when the legs are adjusted in height. That is, the bolt unit, screw-assembled at the base, has a limited length. Therefore, the unscrew height of the leg is limited. However, a user generally adjusts the height of the legs without the unscrew height considered.

If a user completely unscrews the legs from the base because the user adjusts the heights of the legs without the unscrew height considered, the user must reassemble the legs at the base. it is annoying to a user or it takes a long time to install the washing machine. If the legs are over-unscrewed from the base when a user adjusts the legs in height, the legs are unstably disposed at the base. That is, the washing machine is unstably installed. Therefore, the washing machine is vibrated and generates noise when the washing machine operates.

SUMMARY OF THE INVENTION

Accordingly, an aspect of the present invention is to solve at least the problems and disadvantages of the background art. In accordance with an aspect of the present invention, a washing machine includes a base, a plurality of legs, and an over-unscrewed prevention member. The base is formed at a bottom of the washing machine. A plurality of the legs are disposed at the base and each having a bolt unit that is height-adjustably assembled at the base. The over-unscrewed prevention member is disposed at the bolt unit of each leg and caught by the base when the legs are unscrewed so as to set a maximum unscrewed height of the legs.

The base may include through-holes to receive the bolt units. The over-unscrewed prevention member may be disposed at a top of each bolt unit that penetrates the through-hole to be caught at the top of the through-hole when the legs are maximally unscrewed. Also, the through-hole may have an inner circumference surface with a female screw formed to be screwed with a male screw formed at an external circumference surface of the bolt unit. The base may further include a base bracket having assembling holes formed corresponding to bottom surfaces of the through-holes to receive the bolt units with the assembling holes penetrated. The base bracket may be made of a material having hardness greater than the through-hole.

However, the base may include through-holes assembled with the bolt units and a base bracket having assembling holes formed corresponding to bottom surfaces of the through-holes to receive the bolt units with the assembling holes penetrated. The over-screw prevention member may be disposed at an upper part of the bolt unit that penetrates the assembling hole to be caught at a top surface of the base bracket when the legs are maximally unscrewed. Also, the through-hole may have an inner circumference surface with a female screw formed to be screwed with a male screw formed at the outer circumference surface of the bolt unit. The base bracket may be made of a material having hardness greater than the through-hole. The through-hole may include a receiving groove to movably receive the over-unscrewed prevention member to prevent the over-unscrewed prevention member from disturbing when the legs are adjusted in height.

The over-unscrewed prevention member may include a fixing nut or a snap ring, which is assembled and fixed at an upper part of the bolt unit. The over-unscrewed prevention member may be the fixing nut, and the fixing nut is fixed using adhesive after the bolt unit is assembled. The over-unscrewed prevention member may be the snap ring, and the snap ring is detachably assembled at a mounting groove formed along an upper part of the bolt unit. The snap ring may be one of an O-ring, a C-ring, and an E-ring.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

It is an object of the present invention to provide a washing machine for preventing legs from being over-unscrewed or from being completely separated when the legs are adjusted in height.

It is another object of the present invention to provide a washing machine for preventing workability from being lowered and preventing the washing machine from being unstably installed by preventing the legs from being completely separated and from being over-unscrewed.

Hereinafter, a washing machine according to an embodiment of the present invention will be described with reference to accompanying drawings.

Figure 1:
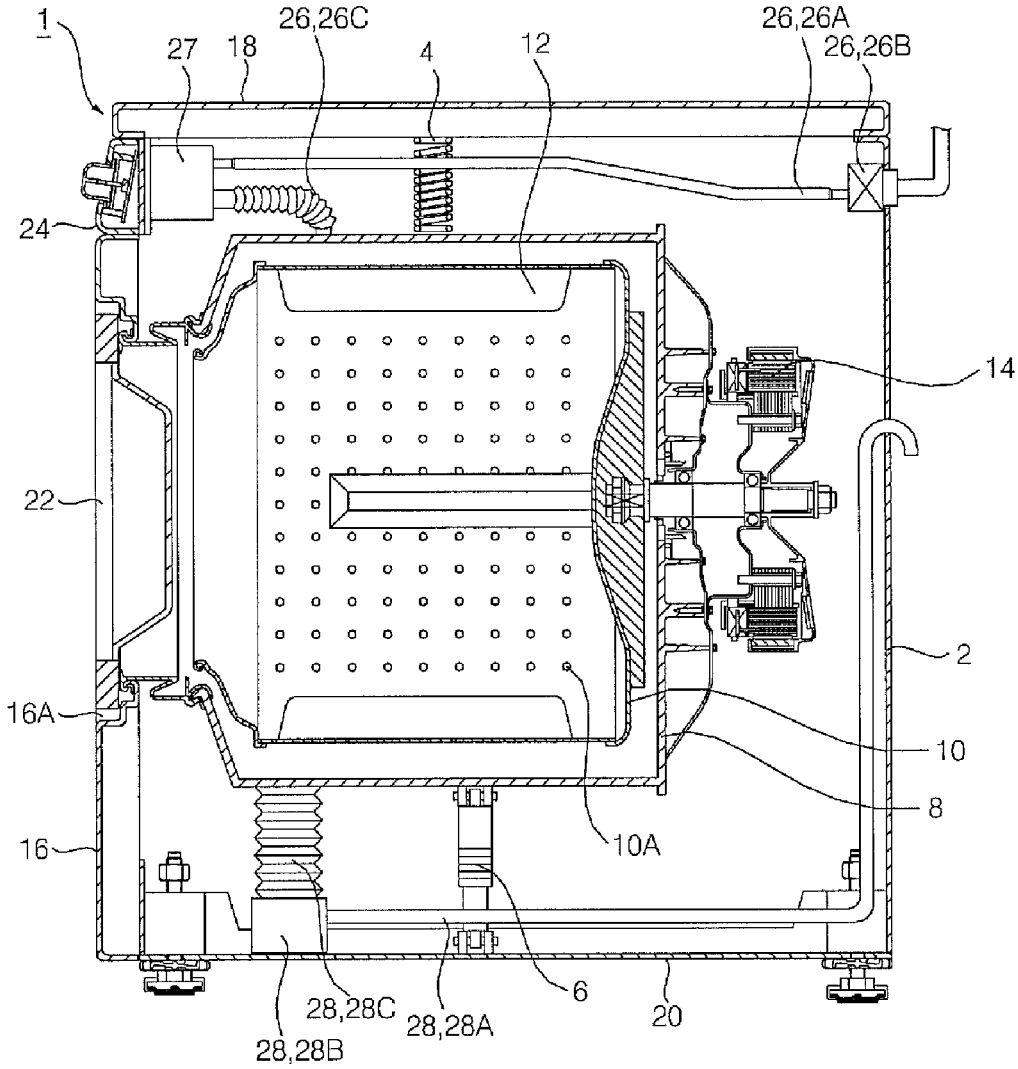
FIG. 1 is a cross-sectional view of a washing machine according to an embodiment of the present invention.
Figure 2:
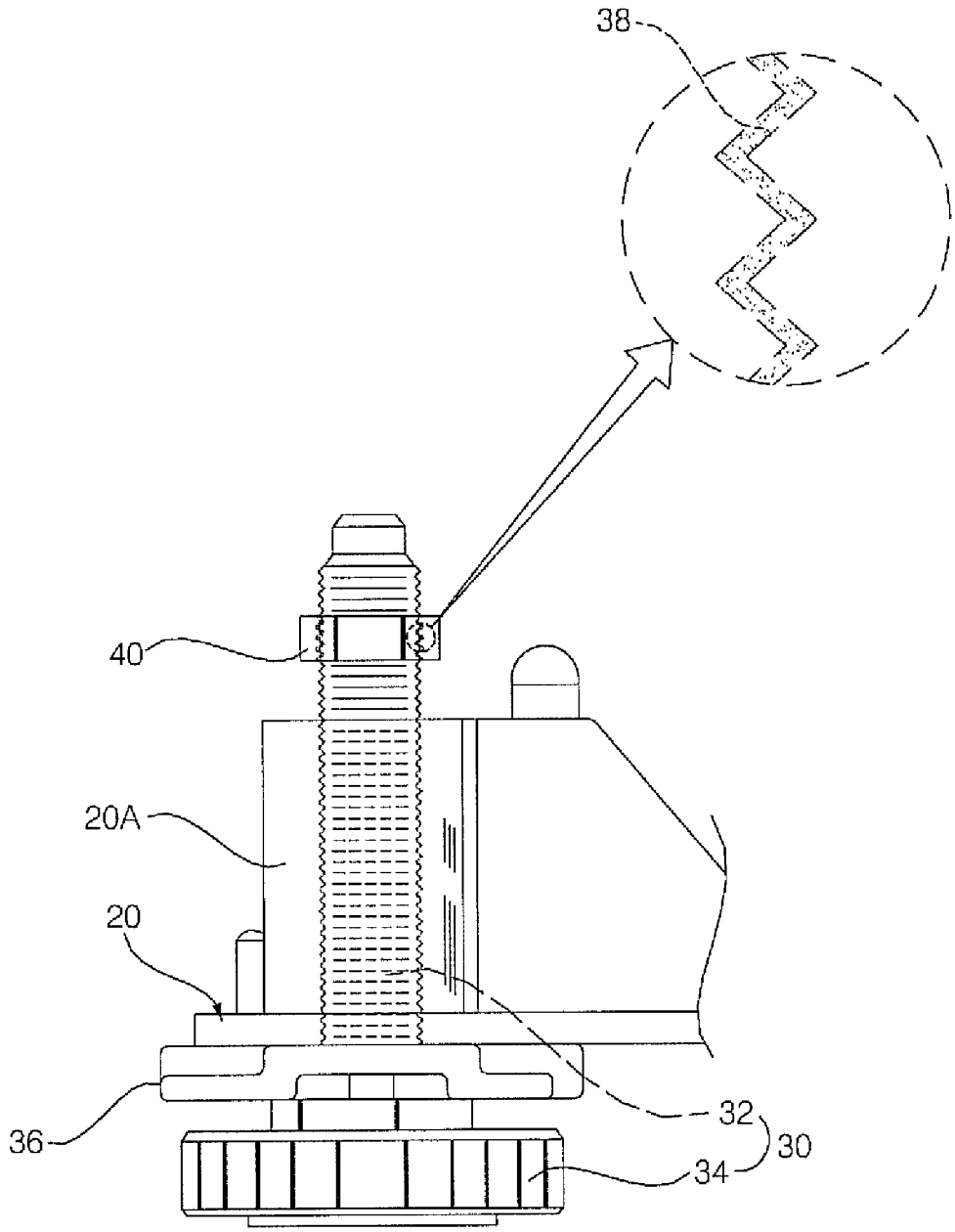
FIG. 2 is a side cross-sectional view of an assembling structure of a base and a leg shown in FIG. 1.
Figure 3:
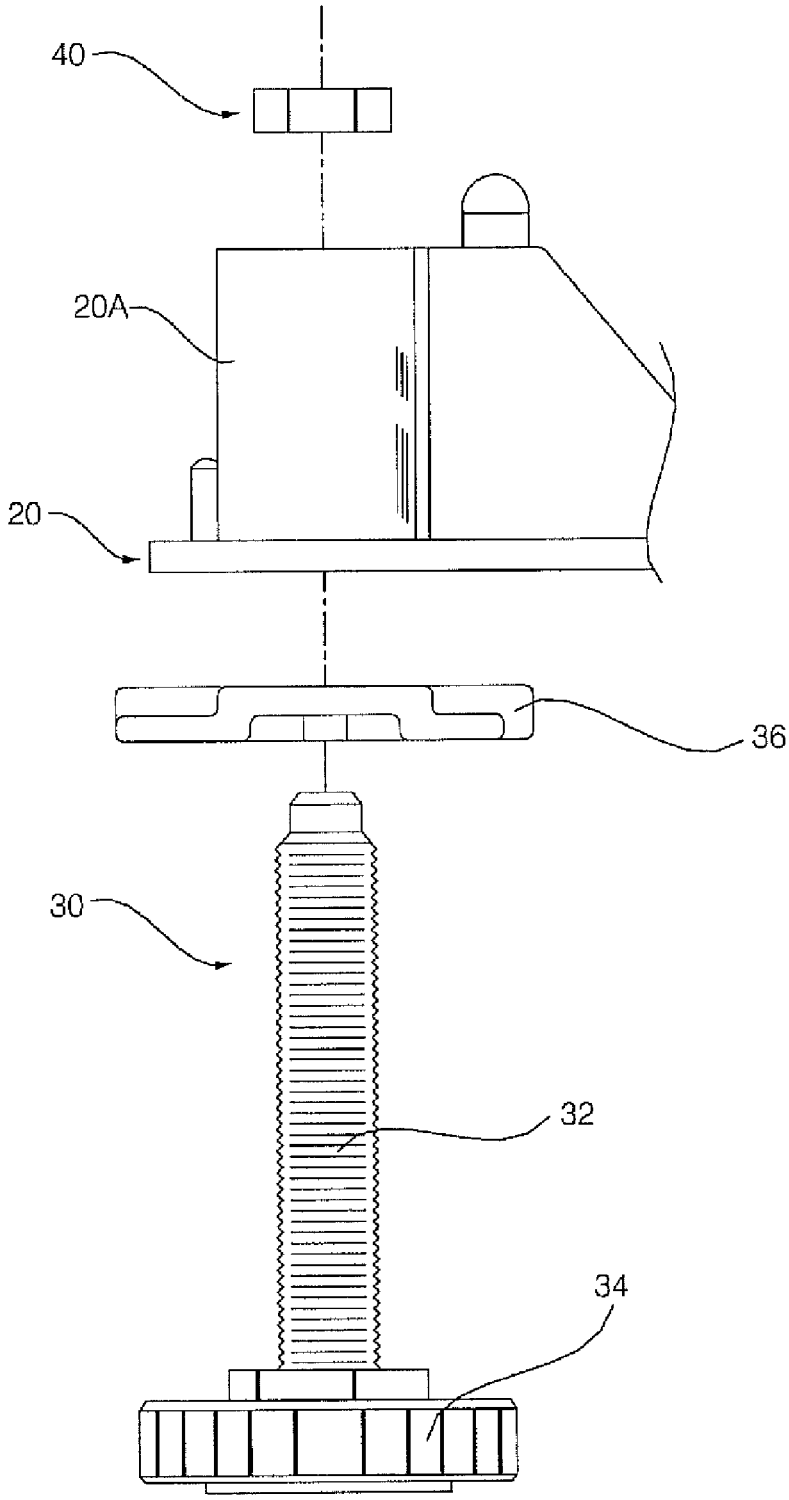
FIG. 3 is an exploded view of the assembling structure of FIG. 2.

FIG. 1 is a cross-sectional view of a washing machine according to an embodiment of the present invention, FIG. 2 is a side cross-sectional view of an assembling structure of a base and a leg shown in FIG. 1, and FIG. 3 is an exploded view of the assembling structure of FIG. 2.

Referring to FIG. 1, the washing machine 1 according to the present embodiment includes a cabinet 2 forming an exterior, a tub 8 horizontally disposed in the cabinet 2, which is elastically supported by a spring 4 and a damper 6, a drum 10 rotatably disposed in the tub 8 and having a plurality of water holes 10A for letting water passing through, lifters 12 for lifting up the water at a predetermined height and letting the washing waster falling, and a motor 14 disposed at the rear end of the tub 8 for transferring a rotating force to the drum 10.

A cabinet cover 16 is disposed at a front side of the cabinet 2 to form a front side of the washing machine 1, a top plate 18 is disposed at the top of the cabinet 2 for forming the top of the washing machine 1, and a base 20 is disposed at the bottom of the cabinet 2 to form the bottom of the washing machine 1. A laundry entrance 16A is formed at the front side of the cabinet cover 16, and a door 22 is rotatably disposed to open or to close the laundry entrance. A control panel 24 is disposed at the upper side of the cabinet cover 16 to display the operating states of the washing machine 1 and to control the operations of the washing machine 1.

A water supply device 26 is disposed between the top plate 18 and the tub 8 to supply water to the tub 8. The water supply device 26 includes a water supply hose 26A having one end connected to the inner side of the cabinet 2 and the other end connected to an external water source, a water supply valve 26B disposed on the water supply hose 26A, and a water supply bellows 26C disposed between the water supply hose 26A and the tub 10 to be communicated to each other. A detergent supply device 27 is disposed between the water supply hose 26A and the water supply bellows 26C to supply the detergent to the inside of the tub 8.

A drain device 28 is disposed between the base 20 and the tub 8 to drain the water from the tub 8 to the outside. The drain device 28 includes a drain hose 28A having one end connected to the inner side of the cabinet 2 and the other connected to the outside, a drain pump 26B connected to the drain hose 28A disposed at the inner side of the cabinet 2, and a drain bellows 28C for connecting the drain pump 28B and the tub 10.

Referring to FIG. 2 and FIG. 3, the washing machine 1 includes a plurality of legs 30 each having a bolt unit 32 assembled to the base 20 to adjust a height thereof, and an over-unscrewed prevention member 40 disposed at the bolt unit 32 for preventing the legs 30 from being over-unscrewed from the base when the heights of the legs are adjusted. The base 20 includes a plurality of through-holes 20A formed at four corners of the base 20 to receive the legs 30. A female screw is formed at an inside circumference surface of the through-hole 20A to be screwed with the bolt unit 32.

The legs 30 are members to adjust the installation height of the washing machine 1 and to horizontally balance the washing machine 1 as well as supporting the weight of the washing machine 1. Each of the legs 30 includes a bolt unit 32 that is height-adjustably assembled at the through-hole 20A of the base and a support 34 disposed at the bolt unit 32 to absorb the vibration of the washing machine 1. The bolt unit 32 is formed lengthily longer than the through-hole 20A in an up and down direction, and a male screw is formed at the outer circumference surface of the bolt unit 32 to be screw-assembled with the female screw.

The bolt unit 32 includes a lock unit 36 for preventing the bolt unit 32 from being rotated after the height of the leg is adjusted by being closely attached at the bottom surface of the base 20. Therefore, the lock unit 36 prevents the leg 30 from being unscrewed by the vibration of the washing machine 1.

The support 34 is a member placed at a location of installing the washing machine 1 for supporting the weight of the washing machine 1. The support 34 is made of an absorbing material for absorbing vibration generated when the washing machine 1 operates.

The over-unscrewed prevention member 40 includes a fixing nut 40 fixed at the bolt unit 32 that penetrates the through-hole 20A to be caught at the top of the through-hole 20A. The fixing nut 40 is fixed at the bolt unit 32 using an adhesive 38 after the bolt unit 32 is screwed at a proper position. The fixing position of the fixing unit 40 is a position where the fixing unit 40 is caught at the top of the through-hole 20A when the leg 30 is maximally unscrewed to stably support the washing machine 1 at the highest height. Therefore, when the legs 30 are unscrewed at the highest height, the fixing nut 40 is caught at the top of the through-hole 20A, thereby restricting the leg 30 from being over-unscrewed. Also, the adhesive 38 is a bond coated on a female screw of the fixing nut 40 or coated on a male screw of the bolt unit 32 for preventing the fixing nut 40 from being rotated.

Hereinafter, a process of assembling a washing machine according to an embodiment of the present invention, and the operations thereof will be described in detail.

At first, a process of assembling the legs 30 to the base 20 of the washing machine 1 will be described. The lock nut 36 is assembled at the bolt unit 32 of the leg 30, and the top of the bolt unit 32 is assembled at the through-hole 20A of the base 20. That is, if the bolt unit 32 of the leg 30 is rotated, the top of the bolt unit 32 is inserted into the through-hole 20A and penetrates the through-hole 20A to the top of the through-hole 20A. If the bolt unit 32 of the leg 30 is screwed in the through-hole 20A at a predetermined height, the lock nut 36 of the bolt unit 32 is closely attached at the bottom surface of the base 20 by rotating the lock unit 36. After the legs 30 are installed, the adhesive 38 is coated on the upper outer circumference of the bolt unit 32 that penetrates the through-hole 20A and the fixing nut 40 is screwed until the adhesive applied part of the bolt unit 32 is reached. Therefore, the fixing nut 40 is fixed at the top of the bolt unit 32 by the adhesive 38.

The coating position of the adhesive 38 is a position corresponding to the through-hole 20A when the legs 30 are unscrewed until the maximum unscrew height of the legs 30 that stably support the washing machine 1. It is possible to coat the adhesive 38 between the bolt unit 32 and the fixing nut 40 after the fixing nut 40 is screwed at the bolt unit 32.

Hereinafter, a process of adjusting the height of the leg 30 will be described. The washing machine 1 is horizontally balanced and installed at a predetermined height that enables a user to conveniently use the washing machine by properly adjusting the heights of the legs 30 according to the installation conditions of the washing machine 1. That is, the bolt units 32 are inserted in the through-holes by rotating the legs 30 assembled in the through-holes 20A of the base 20. Or, the bolt units 32 are drawn out from the through-holes by rotating the legs 30. The installation height of the washing machine 1 is adjusted and the washing machine 1 is balanced horizontally by properly inserting or drawing out the bolt unit 32.

If the legs 30 are over unscrewed from the through-holes 20A when the heights of the legs 30 are adjusted, the fixing nut 40 is caught at the top of the through-hole 20A, thereby restricting the legs 30 from being excessively drawn out. Therefore, the fixing nut 40 prevents the legs 30 from being completely separated from the through-holes 20A of the base 20 or prevents the legs 30 from being excessively unscrewed more than a predetermined height.

Figure 4:
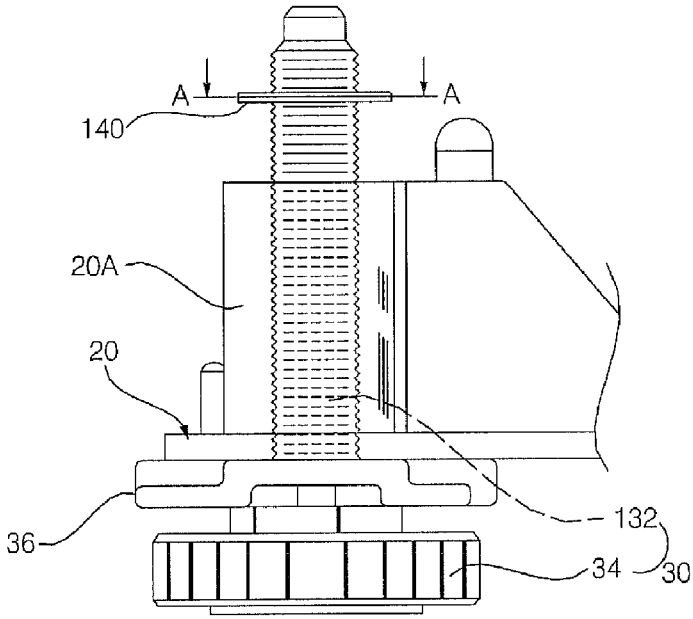
FIG. 4 is a side cross-sectional view of an assembling structure of a base and a leg of a washing machine according to another embodiment of the present invention.
Figure 5:
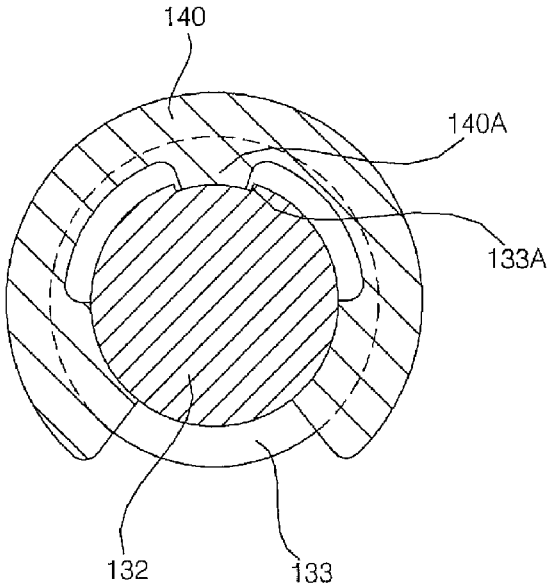
FIG. 5 is a cross-sectional view of FIG. 4 taken along the line A-A.

FIG. 4 is a side cross-sectional view of an assembling structure of a base and a leg of a washing machine according to another embodiment of the present invention, and FIG. 5 is a cross-sectional view of FIG. 4 taken along the line A-A. Like reference numerals denote like elements in FIG. 2, FIG. 3, FIG. 4, and FIG. 5. Hereinafter, the washing machine according to another embodiment will be described based on feature elements thereof, which are different from that shown in FIG. 2 and FIG. 3.

Referring to FIG. 4 and FIG. 5, the over-unscrew prevention member 140 includes a snap ring 140 disposed at the upper part of the bolt unit 132 of the leg 30 that penetrates the through-hole 20A of the base in the washing machine according to another embodiment unlike the washing machine shown in FIG. 2 and FIG. 3. The snap ring 140 is a member formed in a shape of surrounding an external circumference of the bolt unit 132. The snap ring 140 is caught at the top of the through-hole 20A to limit the maximum unscrew height of the leg 30 when the leg 30 is excessively unscrewed.

The snap ring 140 may include an O-ring, a C-ring, and an E-ring. Hereinafter, the snap ring 140 will be described as the E-ring.

The bolt unit 132 includes a mounting groove 133 formed in a corresponding shape of the snap ring 140 along the external circumference of a part where the snap ring 140 is mounted. That is, if the snap ring 140 is an E-ring, the mounting groove 133 is formed along the external circumference of the bolt unit 132 in a corresponding shape of the E-ring. A rotation prevention groove 133A is formed in the mounting groove 133 to receive a protrusion 140A projected from the inner circumference of the E-ring.

Since the snap ring 140 is mounted and fixed at the mounting groove 133 of the bolt unit 132 at once, it is more convenient that the fixing nut 40 shown in FIG. 2 and FIG. 3. Also, it is easy to replace the snap ring 140 assembled at the mounting groove 33 of the bolt unit 132.

Figure 6:
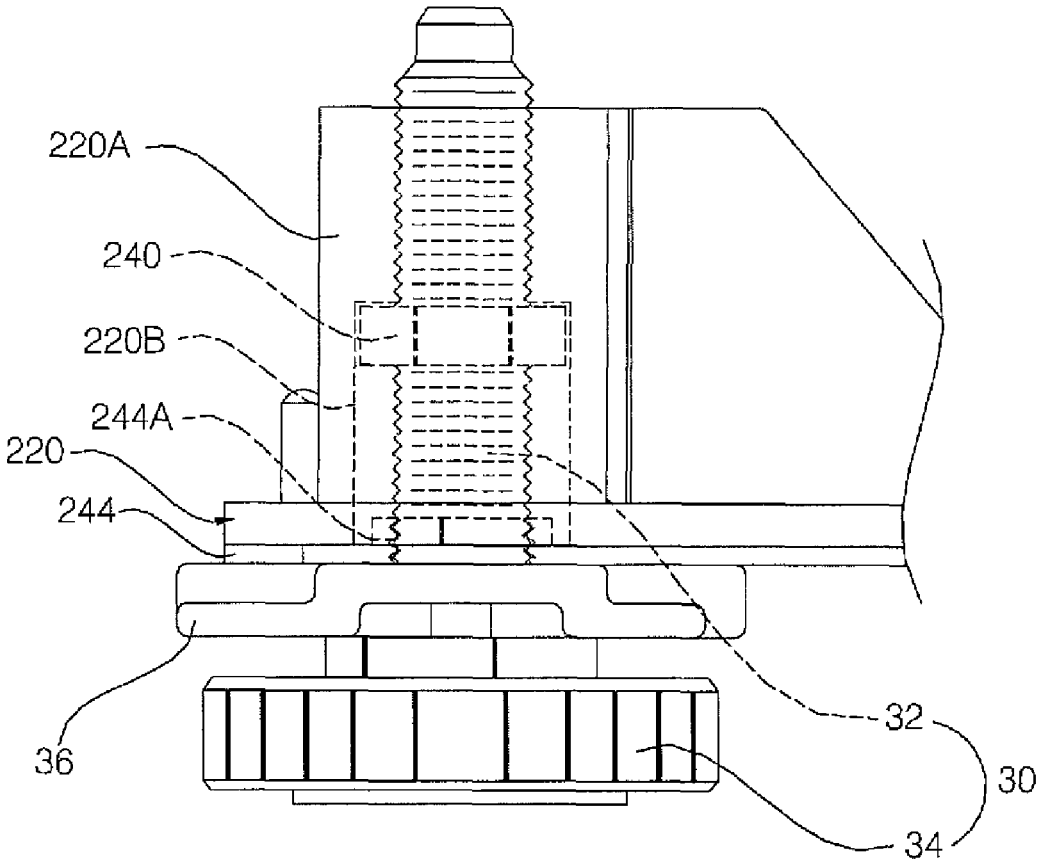
FIG. 6 is a side cross-sectional view of an assembling structure of a base and a leg of a washing machine according to another embodiment of the present invention.
Figure 7:
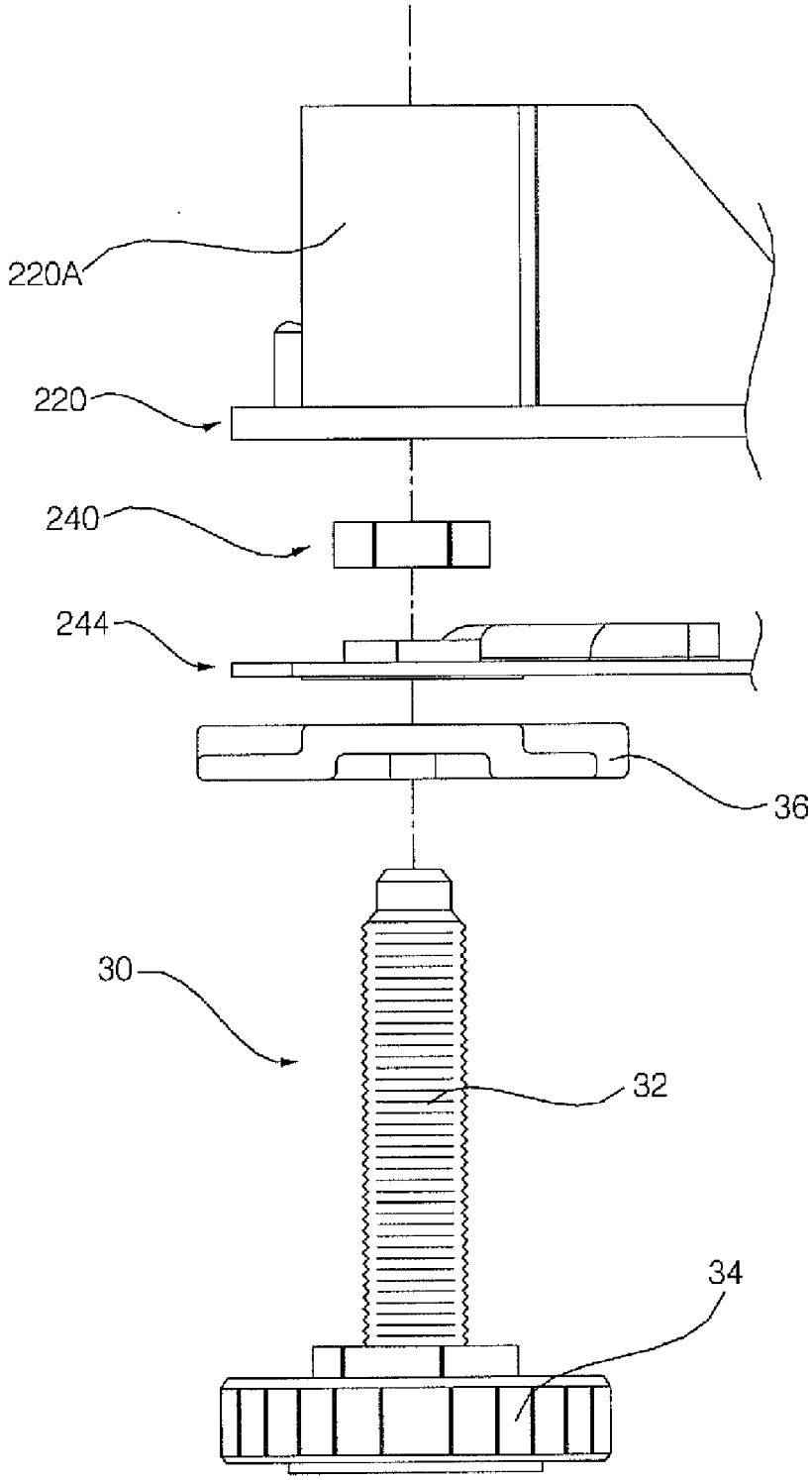
FIG. 7 is a side exploded view of the assembling structure of FIG. 6.

FIG. 6 is a side cross-sectional view of an assembling structure of a base and a leg of a washing machine according to another embodiment of the present invention, and FIG. 7 is a side exploded view of the assembling structure of FIG. 6. Like reference numerals denote like elements in FIG. 2, FIG. 3, FIG. 6, and FIG. 7. Hereinafter, the assembling structure of a base and legs according to another embodiment will be described based on feature elements thereof, which are different from that shown in FIG. 2 and FIG. 3.

Referring to FIG. 6 and FIG. 7, the washing machine according to another embodiment includes a base bracket 244 having mounting holes 244A at the bottom of the through-hole 220A of the base 220 and an over-unscrew prevention member 240 formed at the top of the bolt unit 32 that penetrates the mounting hole 244A, which is caught at the base bracket 244 when the leg 30 is excessively unscrewed unlike the washing machine shown in FIG. 2 and FIG. 3.

The base bracket 244 is a plate member made of metal, which is disposed at bottom surfaces of four corners of the base 220 in order to more stably dispose the legs 30 at the base 220. The base bracket 244 includes an assembling hole 244A formed at a position communicated with the through-hole 220A to receive the bolt unit 32. A female screw is formed at the inside circumference surface of the assembling hole 244A to be screwed with an male screw of the bolt unit 32.

The over unscrew prevention member 240 is a fixing nut fixed at the top of the bolt unit 32 that penetrates the assembling hole 244A to be caught at the top of the base bracket 244 when the leg 30 is excessively unscrewed. That is, the fixing nut 240 is caught at the top of the base bracket 244 when the leg 30 is unscrewed more than the maximum height that stably supports the washing machine 1, thereby limiting the legs 30 to be over-unscrewed. The fixing nut 240, like the fixing nut 40 shown in FIG. 2 and FIG. 3, is fixed at the bolt unit 32 using the adhesive 38 after the fixing nut 240 is assembled at a predetermined position of the bolt unit 32.

Meanwhile, a receiving groove 220B is formed at the bottom of the through-hole 220A to receive the fixing nut 240 in order to allow the fixing unit 240 to move in a up and down direction without being interfered. The height of the receiving groove 220B in the up and down direction is formed to be longer than the height variation of the washing machine that is adjusted by the leg 30.

The foregoing exemplary embodiments and aspects of the invention are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

That is, the over unscrew prevention member is not limited to the fixing nut and the snap rings, and various type of members having a stopper function can be used. Also, the over unscrew prevention member may be caught at other parts as well as the through-hole of the base of the base bracket.

As described above, the bolt unit of the leg is height-adjustably assembled at the base, and the bolt unit of the leg includes the over-screw prevention member that caught by the base. Therefore, the washing machine according to an embodiment of the present invention can prevent legs from being over unscrewed or from being completely separated from the base when the legs are adjusted in height.

Since the washing machine according to an embodiment of the present invention can prevent the legs from being separated or from being excessively unscrewed, the operability of installing the washing machine is improved, and it can reduce vibration and noise generated from the washing machine when the legs are excessively unscrewed from the base.

What is claimed is:

1. A washing machine, comprising:

a base formed at a bottom of the washing machine, the base having a plurality, of through holes formed therein;

a plurality of legs threadably coupled in the plurality of through holes formed in the base, respectively, each of the plurality of legs including:

a bolt that is threadably coupled to a respective through hole of the plurality of through holes formed in the base to allow for height adjustment of the corresponding leg with respect to the base; and an over-unscrewed prevention member fixed to the bolt and movably positioned within the through hole, wherein the over-unscrewed prevention member limits an amount of rotation of the bolt and a corresponding height of the leg with respect to the base; and a base bracket installed at a bottom surface of the base, wherein the over-unscrewed prevention member is configured to engage the base bracket when a position of the bolt in the through hole corresponds to a maximum height of the leg so as to limit further rotation of the bolt threadably engaged in the through hole.

2. The washing machine of claim 1, wherein the base bracket is made of a material having a hardness that is greater than that of the through-hole.

3. The washing machine of claim 1, wherein the over-unscrewed prevention member comprises a fixing nut or a snap ring that is assembled on and fixed to the bolt by an adhesive.

4. The washing machine of claim 3, wherein the over-unscrewed prevention member is the fixing nut, and the fixing nut is fixed to the bolt by an adhesive.

5. The washing machine of claim 1, wherein each of the plurality of through holes comprises:

a first receiving hole that extends from a bottom of the base to an intermediate point of the through hole that defines a top of the first receiving hole; and a second receiving hole that extends from the top of the first receiving hole to a top of the through hole.

6. The washing machine of claim 5, wherein a diameter of the first receiving hole is greater than a diameter of the second receiving hole so as to accommodate movement of the over-unscrewed prevention member fixed to the bolt within the first receiving hole.

7. The washing machine of claim 6, wherein the receiving through hole is threaded so as to threadably engage a distal portion of the bolt.

8. The washing machine of claim 7, wherein a ledge extends between a top peripheral edge of the first receiving hole and a bottom peripheral edge of the second receiving hole so as to form a transition between the first and second receiving holes.

9. The washing machine of claim 8, wherein the over-unscrewed prevention member is fixed to the bolt, and the over-unscrewed prevention member moves together with the bolt and is positioned against the ledge when a position of the bolt in the through hole corresponds to a minimum height of the leg, and the over-unscrewed prevention member is positioned against the base bracket when the position of the bolt in the through hole corresponds to the maximum height of the leg.

* * * * *